US011234458B2

(12) United States Patent
Kaplan et al.

(10) Patent No.: US 11,234,458 B2
(45) Date of Patent: Feb. 1, 2022

(54) **CANNABINOID CONTAINING *CANNABIS* EXTRACT INFUSED INTO ROLLING PAPER**

(71) Applicant: Digital Rarity LLC, New York, NY (US)

(72) Inventors: Benjamin Kaplan, Scarsdale, NY (US); Tobias Paquet, Davis, CA (US); Jason Negrette, Pacifica, CA (US)

(73) Assignee: Digital Rarity LLC, New York, NY (US)

( * ) Notice: Subject to any disclaimer, the term of this patent is extended or adjusted under 35 U.S.C. 154(b) by 70 days.

(21) Appl. No.: 16/508,635

(22) Filed: Jul. 11, 2019

(65) Prior Publication Data

US 2019/0328034 A1 Oct. 31, 2019

Related U.S. Application Data

(63) Continuation of application No. 15/611,033, filed on Jun. 14, 2017, now Pat. No. 10,383,358.

(51) Int. Cl.

| | |
|---|---|
| ***A24D 1/02*** | (2006.01) |
| ***D21H 21/16*** | (2006.01) |
| ***D21H 21/28*** | (2006.01) |
| ***D21H 21/14*** | (2006.01) |
| ***D21H 17/25*** | (2006.01) |
| ***D21H 17/02*** | (2006.01) |
| ***D21H 21/24*** | (2006.01) |

(52) U.S. Cl.

CPC ..... *A24D 1/022* (2013.01); *D21H 17/02* (2013.01); *D21H 17/25* (2013.01); *D21H 21/14* (2013.01); *D21H 21/16* (2013.01); *D21H 21/24* (2013.01); *D21H 21/28* (2013.01)

(58) Field of Classification Search

None

See application file for complete search history.

(56) References Cited

U.S. PATENT DOCUMENTS

| | | | | |
|---|---|---|---|---|
| 2012/0097179 | A1* | 4/2012 | Kesselman | A24D 1/022 131/280 |
| 2018/0027869 | A1* | 2/2018 | Scott | A24D 1/18 |
| 2019/0022158 | A1* | 1/2019 | Greenbaum | A24D 1/002 |

FOREIGN PATENT DOCUMENTS

WO WO 2018/158774 A1 * 9/2018

* cited by examiner

*Primary Examiner* — Dennis R Cordray

(74) *Attorney, Agent, or Firm* — Andrew S. Langsam; Pryor Cashman LLP

(57) ABSTRACT

A rolling paper is formed according to a modified conventional paper-making process. The end product is infused with cannabinoids from an oil extract from the *cannabis* plant. Since paper-making is highly water intensive and the cannabinoid containing *cannabis* extract is an oil that is ordinarily immiscible in the water, an emulsifier is used to allow the cannabinoids to evenly disperse in the making of the paper. The addition of the cannabinoids and the emulsifier is done prior to the drying of the paper. Preferably, the emulsifier and cannabinoids are added during the sizing step of the paper-making. Preferably the emulsifier is a starch-like carbohydrate, a modified starch, more preferably hydroxy-propyl-methyl-cellulose. The cannabinoid containing *cannabis* extract can be added at the pulping, web-forming step and/or preferably at the sizing step of paper-making.

20 Claims, 2 Drawing Sheets

CANNABINOID CONTAINING *CANNABIS* EXTRACT INFUSED INTO ROLLING PAPER

CROSS-REFERENCE TO RELATED APPLICATIONS

The present application is a continuation of U.S. non-provisional application Ser. No. 15/611,033, filed Jun. 1, 2017, the disclosure of which is incorporated herein by reference in its entirety.

BACKGROUND OF THE INVENTION

The present invention relates to the manufacture and end product of rolling paper used for creating a cigarette, whether surrounding tobacco leaves, grounds, seeds of tobacco or that of the flowering plant known as cannabis. More specifically, the present invention relates to manufacturing rolling paper infused with the active ingredient of cannabis, cannabinoids, some of which are known to have psychoactive properties. Often delta-9-tetrahydrocannabinol of cannabis is drawn or pressed from the cannabis plant and it is often generically referred to as a cannabinoid. It seems desirable to provide rolling paper for forming into a cigarette shape with a precise, controlled, uniform and dispersed quantity of the cannabinoid containing concentrate. Thus, the present invention relates to a method and the end product for incorporating cannabinoids as an infused component for paper, primarily intended for use as rolling paper for creating new cigarettes of cannabis leaves and/or tobacco. By infusing the active ingredients of cannabis into and during the paper-making process of the rolling papers, superior content uniformity, manufacturing consistency, and unique cannabinoid concentration control is achieved in comparison to other methods of creating rolling paper with cannabinoid brushed upon, sprayed onto or dropped onto the already finished paper products.

The present invention relates to the method of infusing the extracted cannabinoids, itself a type of oil—one of the active ingredient(s) of the cannabis plant, into the pulp and water mixture as the same is made into paper. It is well known that the paper-making process is a water-based process, indeed, it is highly water consuming. Thus, the extracted cannabinoids which are hydrophobic, and without the steps taken in the present invention, would not uniformly mix and be stabilized in the water, is made miscible and are emulsified. According to the steps of the present invention, the cannabinoids are effectively isolated into small particles which are surrounded by an emulsifying agent which allows the cannabinoids to thoroughly mix and be uniformly distributed throughout the paper-making process, even in the presence of large amounts of water.

The present invention relates to the method of using and infusing cannabinoids during the paper-making process i.e. during actual creation of the paper. This results in a finished product which possesses characteristics of non-infused rolling papers with a concentration consistency and uniform distribution of the active ingredients, cannabinoids, drawn from cannabis plants and leaves. The present invention also relates to the final end product of the inventive method as the same provides a highly concentration-controlled and substantially uniform rolling paper for making cylindrical cigarettes, joints, etc. wherein the paper is infused with cannabinoids and still maintains the characteristics of non-infused rolling paper.

There are many differences between the methods of trying to obtain cannabinoid-infused rolling papers, i.e., dipping, spraying or brushing cannabinoid concentrate onto the finished paper sheets, on the one hand, and infusing cannabinoids concentrate into the pulping, sizing, and formation of the web during the paper manufacturing process, on the other hand. Dipping, brushing or spraying, after the rolling papers are made and dried, in order to achieve a quantity of cannabinoid on the outside of the papers, results in an unsightly and non-uniform outer covering of the cannabinoid oil on the paper and does not maintain the same properties of non-infused rolling paper. This can be messy, sticky, look unseemly, and can even provide an unwarranted odor. The cannabinoid containing coating, whether sprayed, the paper cylinder dipped, or cannabinoids brushed on the outside, will not generally provide a uniform concentration of cannabinoid along the length of the individual rolled cylindrical product nor from one to the next.

In contrast, an end product of rolling paper with cannabinoids infused during the paper-making process goes through a calculated methodology to ensure content uniformity and consistency of the cannabinoid concentration, infused throughout the paper itself. The process requires employing polar and non-polar chemical components to bind the active ingredients of cannabis, the cannabinoids, into the formation of paper (on a very basic level, this process consists of creating a paper pulp which includes water, extracted cannabis concentrate and one or more additional emulsifying substances which allow the extracted cannabis, an oil, to remain uniformly dispersed throughout the water-based paper-making process). Then, after mixing of the components and making the paper, it is dried of most of the water so that only the finished paper and cannabinoid extract infused therein remain. This results in far superior content uniformity of cannabinoid concentration and consistency throughout the paper while still maintaining the same properties of non-infused paper. The extracted cannabinoids and/or the emulsifier component can be added in the paper sizing step, in the paper pulping step and/or in the forming of the paper web step, or in two or more of the steps. The cannabinoids, according to the present invention, however, are not added after the formation of the end product of rolling paper.

Another advantage to infusing cannabinoids into the paper during the paper-making process, as opposed to the brushing, dipping or spraying of the cannabinoids composition after paper formation, is that the cannabinoid infused paper will tend to burn more evenly and slower. This is a clear advantage to the consumer. Another advantage is that the cannabinoid-infused paper does not alter the taste of what is being smoked within the cigarette made of the paper, i.e., the cannabis maintains its taste. This is distinct from other dipped or brushed upon papers as they tend to negatively impact on the taste of the cannabis.

And, the cannabinoid-infused paper won't feel as if it is dipped, sprayed or brushed onto the outside surface of the rolled cigarette or joint, i.e., it will not have sticky finger contact areas. Rather, because of the uniformity of dispersion of the cannabinoids during the paper-making process and the uniformity of the cannabinoid concentration throughout the final dried paper, the rolling papers will feel substantially like non-cannabinoids infused rolling papers.

And, experience seems to evidence that cannabinoid dipped rolling papers are generally not as easy to form into acceptable joints or cigarettes i.e., they are not as easily malleable and formable into small leaf-holding cylinders, whereas the cannabinoids infused into the rolling papers, if the infusion is during the paper-making process will, again because of consistency and uniformity, result in papers that are easier to mold and form into small cylinders.

In addition, it is within the scope of the present invention that the papers themselves actually may be individually edible without the need to roll the same into a cylinder with added grounds, and/or leaf materials. The present invention can be easily used to also make (i.e., in addition to making rolling papers) edible sheets of papers with controlled and uniform concentrations of cannabinoids infused therein. This is clearly superior on many levels to the availability of plain sheets of paper which are after-market sprayed, brushed with or dipped with a cannabinoid containing concentrate.

Again, uniformity and consistency of the papers, infused with cannabinoids during the paper-making process as opposed to spraying, dipping or brushing cannabinoids onto the papers after paper manufacturing is sought. This results in very desired uniformity of concentration from paper to next used or ingested paper. And, using the cannabinoid infusion process of the present invention during the paper-making process allows the manufacture of varying but pre-selected and uniform concentrations of cannabinoids into rolling papers; a highly desirable line of differing cannabinoid concentration products can thus be offered to the public and the consumer can choose which concentration is most desirable for use as rolling papers. Again, this is a direct benefit of the manner of infusing the cannabinoids into the rolling papers during the paper-making process, a process where the concentration and uniformity of the cannabinoid concentration can be precisely controlled.

DESCRIPTION OF THE PRIOR ART

Cannabinoids are well known as the active ingredient of cannabis plants commonly called *Cannabis sativa* and *Cannabis indica*. While illegal to import into the US in quantities, some individual states of the United States have legalized sale for medicinal use and some more states have even presently legalized recreational use. Yet, as of now, there is no large scale manufacturer of cigarettes made from either tobacco or cannabis leaves whereby the paper used to surround the crushed tobacco or cannabis and leaf particles are provided with cannabinoids, the active ingredient of cannabis. Thus users are primarily required to "roll their own" cigarettes, called joints, marijuana cigarettes or reefers in slang.

It is considered desirous to provide rolling papers in short width sheets and suitable lengths for an individual to use in creating a cannabis cigarette or a joint. Often these papers are sold such that one or two sheets can be rolled to form the cigarette shape with the cannabis or tobacco leaves therein. When two sheets are needed (for a larger diameter cigarette) the edges of two sheets are adhered together. The adhering process is usually simply done by licking or wetting one long edge of the papers (pulled from a small container and held there for use in interleaved fashion, much like facial tissues) and aligning the first now-wet edge with the long edge of a second paper sheet. The sheets are frequently provided with water-activated glue or gum adhesive so that the wetting of the long edge activates the glue and thus one long edge of each of the two sheets of the paper can adhere to one another. Thus, after the papers are filled with ground cannabis or tobacco—or particles of cannabis stems, seeds, and leaves, the same are rolled into a cylinder and the second long edge of the paper not yet wetted can be wet (licking usually preferred) to have it adhere to the first paper's free long edge. Thus a cigarette, or joint is "born." Alternatively, of course, a single sheet of rolling paper can be used for smaller diameter cylindrical cigarettes and it can have its long edge (the one with adhesive) wetted and secured to the outside of its opposite long edge to create a cylinder containing ground cannabis material. In any event, it is well known in the culture of cannabis usage that creating a cigarette with the cannabis plant or material on the inside and thin paper on the outside is the primary mechanism to smoke and enjoy cannabis and the psychoactive effect of the cannabinoids.

It is well known that using thin sheets of rolling paper and dipping, spraying or brushing the active ingredients of cannabinoids, mainly delta-9-THC, thereon can provide a greater desired effect or a "boost" to the smoking of cannabis in cigarette, joint or reefer form (hereinafter for ease of illustration simply called a "cigarette"). In the prior art, the THC has been capable of being separated from the leaf by various chemical and physical/mechanical steps. This results in an oily composition of cannabinoids, separated from the remaining physical components of the cannabis plants, stems and seeds. That oil extract has been placed onto the outside of the rolling papers by dipping or dropping quantities (via a medicine-like dropper), spraying or brushing. It has, in the past, generally been done after the rolling papers have been made into their finished product, namely, rolling paper and/or the papers formed into cigarettes. That however should easily be understood to provide a lack of concentration consistency, lack of content uniformity, and an inconsistent concentration of the cannabinoids onto one or more cigarettes.

It is a desired goal of the present invention to provide cannabinoids to a tobacco, hand-rolled cigarette and/or to a cannabis-containing cigarette, formed from rolling papers, with the cannabinoids being provided in a uniform, consistent and controlled concentration manner. In addition, the present invention can be employed in manufacturing of rolling paper for use with tobacco plants/factories and cannabis joints, on a commercial scale, if legal for sale and consumption.

The prior art of paper-making is well known and consists primarily of four distinct manufacturing steps, stations or stages. The steps of forming paper generally are referred to as pulping, forming of the web, sizing, and then drying. For some time, the art of paper-making follows the first three general steps and each of them generally involves the use and consumption of large amounts of water. Water is a critical component in the art of paper-making.

*Cannabis* oil extract is generally obtained by pressing and other mechanical or process chemical steps from the raw cannabis plant. It contains the active ingredients of the cannabis plant and applying it to rolling papers according to the prior art methods or using the newly inventive method disclosed herein for infusing the same into rolling papers is considered highly desirable. It is considered an additive component for the cannabis smoking process. It is considered to provide a jump start and enhancement of the experience. The present invention also allows for precise control of CBD, a cannabinoid, the inclusion of which is important for medicinal purposes—it is not the psychoactive component.

It is well known that very polar molecules, e.g., water, are not generally miscible with hydrophobic molecules such as those that are found in cannabis oil extracts. *Cannabis* extracts do not readily mix with water and therefore are not uniformly dispersed throughout the water matrix when added to water in a container or as an additive to a water using process but, rather, the oil will tend to stay with other oil molecules, separate from the water molecules.

Yet, as mentioned, if the desired goal of the present invention is the provision of cannabinoid-infused rolling paper (i.e., paper having cannabinoids thoroughly mixed into the paper during the paper-making process, which is inherently based on water processes) as paper-making process necessarily requires large amounts of water. If the goal is the provision of cannabinoids, one or more of the extracts from the cannabis plant, an oil, uniformly infused or integrated into the paper, then there is a chemical/physical "conflict" as the water in the paper-making process and the oily nature of the cannabinoids are ordinarily immiscible, i.e., will not tend to mix with one another into a uniform and consistent solution.

The present invention, however, provides a rolling paper using a quasi-traditional or conventional paper-making process with steps of pulping, forming of the web, sizing and then drying, and, yet, allows cannabinoids to be infused during the process uniformly, evenly and with consistent concentration. The present invention uses a stabilizing emulsifier to effectively and efficiently infuse cannabinoids into the rolling paper, during one step, the sizing of the paper, a step in the paper-making process. The emulsifier can be used at one or multiple times during the paper making process where and when a water-based step is performed. Preferably, according to the present invention, the emulsifier will be used in the pulping stage. Further preferably, the emulsifier will be also used during the forming of the web stage. And, in addition, most preferably, the emulsifier can be used during the sizing process of the paper-making process. The use of the emulsifier, a modified starch, preferably, hydroxypropyl-methyl-cellulose, according to the present invention, can be done in each, combinations or in all of the steps of rolling paper manufacturing, whenever the use of water is present.

On a molecular level, the emulsion exploits the amphiphilic nature of the starches used in the paper-making process. Different carbohydrates in solution with water comprise critical components involved paper manufacturing. The cannabinoids, during the rolling paper-making process, will become surrounded by the carbohydrate units as a consequence of the use of the emulsifier and the carbohydrate units thus create, with the surrounded cannabinoid molecules, a colloidal suspension of molecules in water, an aqueous solution.

It is known to use starch to emulsify oils into water. However, to the Applicant's knowledge, it has not been thought of to use an emulsifier in the water-intensive process of paper-making for manufacture of rolling paper such that cannabinoids, the active ingredient of cannabis, can be fully integrated, uniformly, evenly and with known and controlled concentration into the paper for making cigarette or joint rolling papers.

U.S. Published Patent Application Document No. 2015/0181925 relates to an herbal smoking blend including THC in solution added to rolling paper. The description talks about immersing, dropping and/or impregnating the paper and/or the leaves (of tobacco or cannabis) with the cannabinoid or THC solution. It also teaches adding it to rolling paper or impregnating rolling paper for smoking products. This does not teach nor suggest the problem with the difficulty of miscibility of the cannabinoid-containing oil in a water-based process of making paper nor does it provide a solution for the problem. The present invention isolates and surrounds the cannabinoid oil molecule such that it can be thoroughly and evenly mixed into the pulp during one or two or more steps of the paper-making process.

Another reference of interest is U.S. Published Patent Application Document No. 2016/0029690. It relates to homogenized tobacco and herb rolling papers or cannabis-containing rolling paper. The methods of making the paper include vapor deposition, coating, dropping, etc. The present invention is patentably distinct in that it thoroughly mixes the cannabinoid containing oil into the water used in the paper-making product by using an emulsifier for the water-based step(s) of the process. This seems neither taught nor suggested by the prior art and, indeed, there seems to be an absence in the prior art of recognition of the problem of mixing the cannabinoid concentrated composition, in effect an oil, into the water used in the pulp making process of paper-making.

And, U.S. Pat. Nos. 9,095,173; 8,469,038; 8,944,073; 8,161,979; and 8,869,803 are related to the general background of the present invention. These relate to the above pending US Published Patent applications and also seem to contain language which relates to the general concept of homogenizing tobacco and herb rolling paper or rolling paper provided with cannabis, by deposition, solution, dropping, coating, etc. The same comments previously made with respect to the published and pending patent applications apply to these references.

U.S. Patent Publication No. 2015/0107614 teaches homogenized tobacco or rolling paper (see paragraph 0011) including cannabis (paragraph 0073).

U.S. Patent Publication No. 2015/0083142 relates to having tobacco rolling paper and/or sheets of other homogenized smokeable materials (see paragraph 0018 which suggests cannabis for the paper) and then suggesting the inclusion of cannabis (see paragraph 0062) for the filler material. There is, however, no teaching nor suggestion of the use of an emulsifying agent during the paper-making process to allow for uniformity of concentration and uniformity of mixing between the cannabinoid containing oil, and the water used in the paper-making process. This step is provided and taught by the present invention.

U.S. Patent Application No. 2015/0013693 shows the use of a flavorant added (by drops or direct contact) to rolling papers for tobacco or cannabis (see paragraph 0032) while Printed and Published U.S. Patent Document No. 2008/0271745 relates to sheets of outer smokeable materials (paragraphs 0031 and 0032) and forming casings for smokeable products with sheets of cannabis (see paragraphs 0036). In the '693 reference there seems to be a specific suggestion of using a diffusion of the flavorant onto the rolling papers. Paragraph 17 thereof states that the concept of diffusing flavorant into tobacco products includes the concept of using cannabinoid for the same. However, there seems to be an absence of a teaching or a suggestion therein of using an emulsifying agent to allow for content uniformity and mixing thoroughly of the cannabinoid containing oils, into and with the water of one or more of the steps in the paper-making process. This is provided by the present invention.

U.S. Pat. No. 9,408,986 shows the concept of using cannabinoid vapor with a substrate in connection with making rolling papers for tobacco and/or cannabis smoking. It, too, generally relates to the subject matter of the present invention but does not teach infusing the cannabinoids into the paper during the paper-making process by adding during the pulping or web-forming step or adding during the sizing step with an emulsifying agent, a modified starch, preferably hydroxy-propyl-methyl-cellulose.

SUMMARY OF THE INVENTION

The present invention relates to making consistent concentrations of cannabinoid-containing/infused rolling paper. According to the invention, rolling papers are infused with cannabinoids, the active ingredient of cannabis, in a uniform, even and consistent concentrated manner. The present invention includes the infusion of the cannabinoids during one or more of the water using steps of paper-making. Yet, as mentioned, paper-making is inherently highly dependent upon the use of large quantities of water. Paper-making employs the use of a binding agent, a filling agent and a sizing agent. The present invention preferably infuses the cannabinoid-containing components during the pulping and/or the sizing agent's addition and usage in the paper-making process. Primarily, however, the present invention infuses the cannabinoids into the sizing agent. Yet, as mentioned, the cannabinoids can be added, with an emulsifying agent, during any one of the water-using steps of paper-making, pulping, filling, web-forming, and/or sizing.

Paper-making is a process of formulating and then drying pulp. It is a well-known process and has been used in various forms for thousands of years, dating back to the early Chinese and Egyptian civilizations, the latter starting with reeds. The pulp making step results in paper and includes today the use of a binding agent, a filling agent, and a sizing agent, along with large quantities of water for each step of the process.

According to one preferred embodiment of the present invention, cannabinoids are infused into the webbing. The pulp, now with cannabinoid, is then sized and, here, too, it is an aspect of the present invention to consider the spray of cannabinoid-containing emulsion onto the sizing rollers (performed prior to or even after drying) such that a first and/or even a second application of cannabinoids are infused into and onto the pulp, during the paper-making process.

According to the present invention, a cannabinoid-infused paper sizing agent formulation for infusion into paper during the paper manufacturing process is provided. This is just one example of how to infuse the cannabinoids into the paper manufacturing process, i.e., by adding it with the sizing agent along with an emulsifier and other methods may reasonably appear to those of ordinary skill in the art.

According to this preferred method, the cannabinoids are intended to be infused into the sizing agent used during the paper-making process. The liquid combination of normal paper-making components of pulping materials with cannabis oil is accomplished by the present invention by use of carbohydrates, starches, a modified starch, preferably hydroxy-propyl-methyl-cellulose, etc., acting as the emulsifier for the cannabinoids, having an oil-like and hydrophobic character, such that the cannabinoids will tend to uniformly mix with the water which is a crucial component of the paper-making process. The carbohydrate, starchy emulsifier tends to surround and chemically bond or isolate the cannabinoid molecules and this allows the now-surrounded cannabinoids containing molecules, otherwise hydrophobic and not miscible with water, to more evenly disperse in water, along with the other paper-making components.

According to currently preferred steps of the invention, the emulsion used for surrounding the cannabinoids during the infusion of the sizing agent, preferably a spray-on sizing agent, during the paper-making process, is comprised of a modified starch, and preferably methylcellulose and water. More preferably, the emulsifying agent for the sizing step is a modified starch, preferably hydroxy-propyl-methyl-cellulose. In addition a quantity of sorbitol is preferably added during sizing as a flavor enhancer. This allows for the finished product to be merely ingestible as individual sheets of paper, in the event that the papers are not used for rolling cannabis. Of course, the bulk of the spray-on sizing agent is water. The glycerine (helpful to control flexibility of the dried infusion), water, sorbitol and methylcellulose or another modified starch or, preferably, the hydroxy-propyl-methyl-cellulose will create a quantity of sizing agent for use in the sizing step of the manufacture of rolling paper. Attached hereto and incorporated herein as Appendix B is a Standard Operating Procedure for manufacturing and testing the sizing agent precisely in a laboratory environment. The sizing agent, with the emulsifier, is combined with the cannabinoid containing cannabis extract. That combination, too, can be first simulated in a lab for initial quantity and concentration control. That, too, is described in Appendix B, attached at the rear of the specification and made a part hereof by incorporation by reference.

According to the process and the step of adding the cannabinoid during the preliminary pulping stage, the cannabinoid containing cannabis extract is mixed with ethanol. The oil of the cannabinoid containing cannabis extract and the ethanol can be mixed to create a homogenous tincture. The mixture of cannabinoid containing cannabis extract and ethanol is combined with water and then combined and mixed with cellulose and other binders and fillers. That, then, is conveyed to the web-formation stage.

According to another alternative or additive step of the present invention, the cannabinoid containing cannabis extract can be alternatively or as a second addition, added to the sizing step, but, here, an emulsifier is preferably provided. Preferably the emulsifier is a modified cellulose, a starch, most preferably, it is hydroxy-propyl-methyl-cellulose. That mixture of the cannabinoid containing cannabis extract and the emulsifier comprises the sizing agent. It is preferably sprayed or applied to the pulp composition (formulated according to the prior steps, i.e., methylcellulose, sorbitol, water, and glycerine). According to the steps for simulating full scale production, performed in a test and quality control lab, 100 milligrams of the cannabinoid infused paper sizing agent formulation is combined with the pulp.

According to another standard operating procedure of laboratory simulation of the cannabinoid infused rolling paper of the present invention, attached to the rear of this specification as referred to as Appendix A—and incorporated by reference herein, the Cannabinoid infused rolling paper is made from a combination of hemp, flax, rice and/or wood components. To create the end product desired, one needs a quantity of pulp primarily made of hemp, rice, wood and/or flax. Water is used, too; in the lab preferably distilled water. Ethanol, of about 200 proof, is needed along with a quantity of calcium carbonate, methyl cellulose, titanium dioxide and cationic starch. A quantity of cannabinoid containing cannabis extract needs to have been first made as that is the critical ingredient sought to be infused into the rolling paper. In addition, magnesium carbonate is desired.

First, the bulk of the paper needs to be selected, wood, hemp, flax, or rice are preferred and can be used individually or combined together to advantage. Then water is added. The 200 proof ethanol then added to the bulk and water mixture. This is then blended by a pulp blender.

After blending, a quantity of the calcium carbonate is mixed along with methyl cellulose, then the titanium dioxide.

According to the invention, the cationic starch is then added along with the magnesium carbonate. All are blended together. The expected quantities of each are, of course, based on the desired end quantity of paper, concentration of THC, THCa, CBD, CBDa, CBN, etc. i.e., the cannabinoid containing cannabis extract.

After blending, the cannabinoid containing cannabis extract is dispensed. Mix a small quantity of the ethanol with the cannabinoid containing cannabis extract. That mixture of ethanol and Cannabinoid tincture is then mixed or blended with the paper slurry and mixed for about 20 minutes. A web deckle is then formed by sandwiching a screen and grid piece between wooden deckle pieces. The deckle structure is then placed into a preferably silicone rectangular basin and the blended paper and Cannabinoid slurry placed on and through the deckle screen until the level of liquid in the basin is above the screen's level. The deckle sandwich is gently squeezed and moved back and forth under the slurry layer to achieve an even dispersion of the web slurry. Then the sandwiched deckle is lifted from the basin and turned at 90 degrees so that the deckle may rest above the slurry level and to drain effluent whitish water back into the basin. The deckle should be allowed to drain and partially dry. Then as further drying is desired, it can be done in the air or, more likely, with a felt drying sheet placed on top of the web. Further drying is performed. A power heat press can be employed in the lab for further and quick drying. If available, the web can be placed therein for a minimum of about 700 seconds at about 110 degrees Celsius. The dried paper can be removed from the drying sheets of felt and/or the couch paper, if used. This will produce one or more sheets of rolling paper with cannabinoid infused uniformly therein. Of course, scaling this process to full scale factory production will need to be done but that, too, is clearly expected to be within the skill of the ordinary person skilled in the art of paper-making and the chemistry of paper-making.

As mentioned, cannabinoid containing cannabis extract is an oil and as an oil it is hydrophobic, i.e., does not mix with water molecules. The paper making process is, in general, a user of large quantities of water. Thus, mixing, in a uniform manner, the cannabinoid containing cannabis extract oil with the water used in the paper-making process is inherently in conflict. The present invention uses. At the sizing stage of paper-making, an emulsifier for surrounding the cannabinoid molecules which then allow the same to be easily and substantially uniformly dispersed in the water among the carbohydrates, the components of the cellulose which form the bulk of the paper, the end product. The surrounding of the cannabinoid with a starch, modified starch, preferably hydroxy-propyl-methyl-cellulose, an effective emulsifier allows the cannabinoids to be surrounded, and the same is thus infused into the sizing agent. In effect, the carbohydrates are allowing the cannabinoid to become miscible or soluble in the sizing agent. The cannabinoid is thus emulsified by the starch/modified carbohydrate, preferably hydroxy-propyl-methyl-cellulose.

The use of the emulsifier with the cannabinoid containing cannabis extract in the paper-making process is quite stable at room and temperature and for a period of time, namely, days. At any time during its shelf life, the emulsion can be sprayed onto the sizing components i.e., generally rollers passing through baths or the paper is passed through a bath of sizing components and this leads to cannabinoid infusion into the sizing mechanism with uniform content and concentration. The infusion leads to uniformity on the paper in comparison to prior art methods where the cannabinoids would otherwise be dropped onto or brushed onto the dried paper, after the paper-making process. The making of the rolling paper in this manner, i.e., use of an emulsifier agent during the sizing step of paper-making results in uniformity of dispersal of the cannabinoids throughout the paper, the desired goal of the present invention. The modified starches, provided with the emulsifier, allow the cannabinoids to basically be uniformly dispersed in the water of the paper-making process. The rolling paper can be used for making tobacco, other leaf cigarettes, cannabis rolling paper and even merely edible sheets of paper infused with cannabinoids.

Pulp includes the binding agent and the filling agent and large quantities of water. Then, the sizing agent is added. The present invention infuses the cannabinoids into the sizing agent for uniform results. The paper directly and/or the sizing roller is sprayed with cannabinoids (in effect the sizing agent is first provided with cannabinoid as infused as a consequence of the emulsifier agent) and then the roller with the sizing agent is used and can again be sprayed with cannabinoids or the same can be applied directly during the sizing step. A double (or more) dose of cannabinoids can thus be easily applied.

The present invention is the infusion of cannabinoids into the forming of the webbing, the pulping step, and/or in the sizing step, to make rolling paper uniformly infused with cannabinoids and in a controlled concentration. The present invention is specifically directed to infusing cannabinoids during the paper-making process by use of an emulsifying agent, preferably a carbohydrate or starchy substance, more preferably a hydroxy-propyl-methyl-cellulose, which allows and enables the otherwise hydrophobic nature of the cannabinoid containing cannabis extract to mix with the water, a necessary and large component of the paper-making process.

DETAILED DESCRIPTION OF THE INVENTION

According to the preferred embodiment, cannabinoids are infused into paper during the paper-making/creation process. It is well known that the paper-making process uses a significant amount of water in the various steps of the process. According to well-known paper-making processes, there are three or four principal steps, pulping, filling or web forming, and sizing (and then drying). A binding agent is often used in the creation of paper. To form conventional rolling papers, a binding agent is used in one step, a filling agent used in another step and a sizing agent also used.

Figure 1:
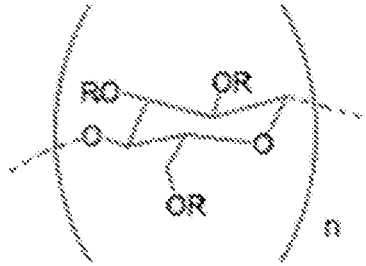
FIG. 1 is a chemical formula showing one form of a single starch unit used in connection with the present invention and FIG. 2 shows a representative set of chemical formula showing cannabinoid structures.

According to the preferred embodiment of the present invention, the infusion of the cannabinoids, in the form of a liquid, is desirably done during the sizing step but can also or alternatively be performed during the pulping, binding step and/or the filling step of paper-making. FIG. 1 shows a representative chemical formula for the single starch unit useful in connection with the present invention.

The basic chemical formula for a single representative starch unit for use in the present invention is shown in FIG. 1.

Figure 2:
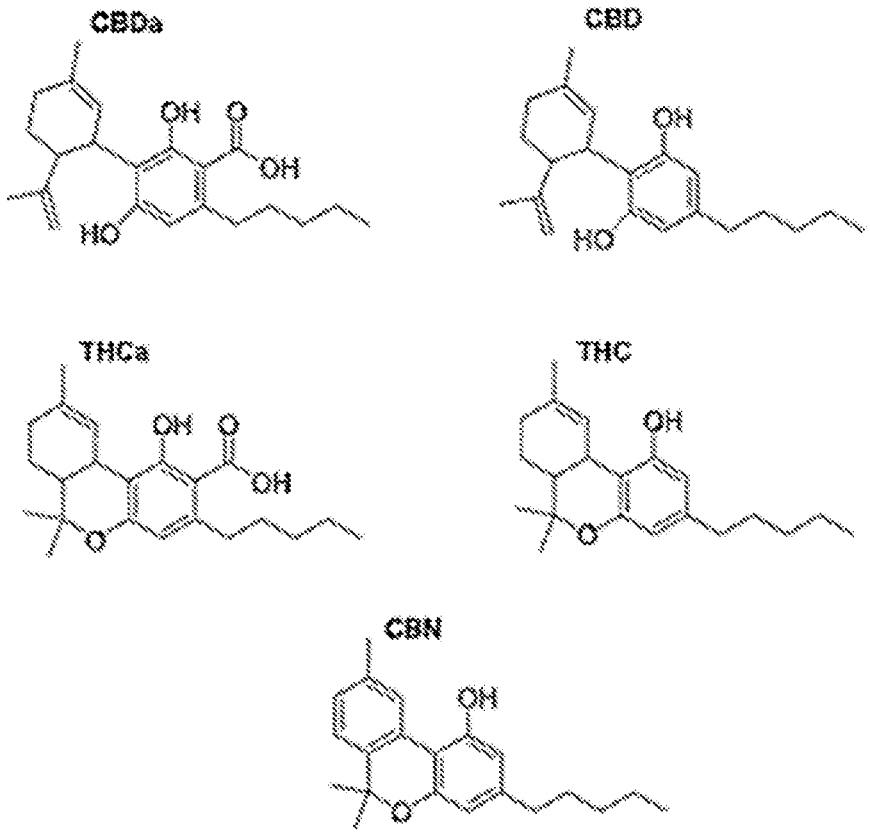

Since cannabinoids in liquid form, made from extracting cannabis plant material is substantially an oil and hydrophobic, merely adding it into one of the steps of the paper-making process, which uses quite a bit of water, will not result in consistency of concentration as the oily nature of the cannabinoid containing cannabis extract will tend to stay away from the water. FIG. 2 shows chemical formulas and are representative Cannabinoid structures used in the present invention.

It is a critical component of the present invention to use an emulsifier, at least if the cannabinoid containing cannabis extract is to be added at the sizing step. The emulsifier will tend to surround the molecules of the cannabinoid containing cannabis extract and allow it to be much more evenly dispersed in and among the water molecules. This is preferably done during the sizing step but can alternatively or in addition be done during the pulping, web forming, binding and/or filling steps. The use of the emulsifier allows the paper pulp to remain quite stable with the cannabinoids infused therein. Then, the next steps, as are conventional, are followed to produce the right thickness, weight, length and width of the paper sheets. Preferably, the individual sheets are cut to size, interleaved, provided with at least one edge with a small quantity of water-activated adhesive, and sealed in an appropriate box.

As mentioned, the use of an emulsifier during and at the sizing stage provides a stable emulsion for the cannabinoid containing cannabis extract. Preferably the emulsifying agent is a starch, more preferably a modified starch and even more preferably a hydroxy-propyl-methyl-cellulose.

The step of sizing, during the paper-making process, is generally done by spraying the sizing agent onto a set of rollers, carrying the paper pulp down the paper producing line of manufacture. It is during this spray step of sizing agent, before drying, that the cannabinoid containing cannabis extract is mixed with a carbohydrate starch emulsifier to make an emulsion which results in a composition which is capable of being mixed with water as the oily cannabinoid containing cannabis extract will become surrounded by the starchy emulsion and evenly dispensed in the water.

The infusion of the cannabinoids into the paper, during the paper-making process, preferably during the sizing step, results in superior uniformity of the concentration of cannabinoids within the paper. Then, when this rolling paper is used with tobacco, cannabis, or another leafy substance the cannabinoid, infused into the paper, will be activated by the heat of the lighting or burning of the cigarette which will tend to "jump start" or boost the considered pleasant effect of the smoking of the same.

By using an emulsifier with the cannabinoid containing cannabis extract, preferably a modified carbohydrate or starchy substance (See representative FIG. 1 of the basic chemical formula) more preferably hydroxy-propyl-methyl-cellulose, the cannabinoids tend to become somewhat miscible with the water and this allows the same to be effectively used in the paper-making process. A uniform concentration of cannabinoids throughout the surface area of the paper is the result, far superior uniformity than that obtained by spraying cannabinoid containing cannabis extract onto the already dried, folding papers, at the time of use, and far more evenly concentrated and controlled in concentration than using a brush, dipping, and/or dropping small droplets of cannabinoid containing cannabis extract onto a rolled cigarette with dried rolling papers.

The cannabinoids, when surrounded with the starchy/carbohydrate emulsifier leads to an emulsion which is a highly stable composition over long time periods (useful for shelf life of the rolling papers) and is also stable at a wide range of expected room temperatures.

Appendix A shows a standard operating procedure of laboratory simulation of the cannabinoid infused rolling paper of the present invention. The Cannabinoid infused rolling paper is made from a combination of hemp, flax, rice and/or wood components.

APPENDIX A

1. Title: Cannabinoid Infused Rolling Paper Prototype Creation
2. Purpose: This SOP describes the process of creating a cannabinoid infused rolling paper prototypes including hemp, flax, rice, and wood.
3. Scope: This procedure pertains to any manufacturing or processing personnel performing cannabinoid infused rolling paper prototype creation.
4. Responsibility: The Quality Assurance Manager shall ensure that any manufacturing and quality control personnel are trained and proficient to complete this SOP properly.
5. References:
   5.1: "The Papermaking Process" a general guide to paper manufacture and formulation
6. Abbreviations and Definitions:
   6.1: THC: Delta-9-Tetrahydrocannabinol, CAS #1972-08-3
   6.2: CBD: Cannabidiol, CAS #13956-29-1
   6.3: Blended Paper Slurry: a liquid combination of paper making components and cannabis oil
7. Frequency:
   7.1: Utilize when the creation of a cannabinoid infused rolling paper prototype is needed.
8. Equipment and Supplies Necessary to Complete SOP:
   8.1 C3001S: Cannabinoid Infused Rolling Paper Prototype Creation Sheet
   8.2 Cannabinoid Oils Corresponding which have been tested for potency and safety by 3rd party analytical services.
   8.3 Calibrated Analytical Balance
   8.4 Weighing Dish
   8.5 500 mL graduated cylinder
   8.6 Calculator
   8.7 Pulping Blender with a>1 L capacity
   8.9 Power Heat Press with a 1 ton capacity and the ability to heat up to at least 110 C
   8.10 Papermaking raw materials:
   8.10.1 Pulp: Hemp, Rice, Wood, Flax
   8.10.2 Distilled Water
   8.10.3 200 Proof Ethanol
   8.10.4 Calcium Carbonate
   8.10.5 Methyl Cellulose
   8.10.6 Titanium Dioxide
   8.10.7 Cationic Starch
   8.10.8 Magnesium Carbonate
   8.10.9 Papermaking Deckle and Screen Set
   8.10.10 2 Dram Jar
   8.10.11 Silicone rectangular basin
   8.10.12 Drying Felt and Couch
9. General Information:
10. Procedure:
10.1 Utilize a Calibrated Mass Balance for each mass measurement located in C3001S: Cannabinoid Infused Rolling Paper Prototype Creation Sheet 10.2 Choose the pulp type raw material: Hemp, Wood, Flax, or Rice 10.3 Create a Sample number for the prototype being created 10.4 Choose the desired number of prototypes to be created and the expected mass of a single paper 10.5 Dispense Water 10.5.1 Place the 500 mL graduated cylinder on the mass balance and press the tare button 10.5.2 Dispense 280 grams of water into the graduated cylinder and record the volume into C3001S: Cannabinoid Infused Rolling Paper Prototype Creation Sheet 10.6 Dispense Ethanol 10.6.1 Place the 500 mL graduated cylinder with water on the mass balance and press the tare button 10.6.2 Dispense 152 grams of 200 proof ethanol into the graduated cylinder and record the change in volume into C3001S: Cannabinoid Infused Rolling Paper Prototype Creation Sheet 10.6.3 Dispense the total contents of the 500 mL graduated cylinder into the pulping blender 10.7 Dispense Paper Making Constituents 10.7.1 Depending on the number of prototypes that were chosen to be made, the expected mass of a single paper, and the desired percentages of each component, C3001S: Cannabinoid Infused Rolling Paper Prototype Creation Sheet will instruct the operator on how much of each paper constituent to dispense 10.7.2 Dispensing of Pulp Starter 10.7.2.1 Input the "Desired % of pulp starter" into C3001S: Cannabinoid Infused Rolling Paper Prototype Creation Sheet 10.7.2.2 Place a weighing dish on the mass balance and press the tare button 10.7.2.3 Dispense the mass calculated from column "Target Mass of pulp starter (mg)" and record the mass in column "Measured Mass of pulp starter (mg)"

10.7.3 Dispensing of Calcium Carbonate 10.7.3.1 Input the "Desired % of Calcium Carbonate" into C3001S: Cannabinoid Infused Rolling Paper Prototype Creation Sheet 10.7.3.2 Place a weighing dish on the mass balance and press the tare button 10.7.3.3 Dispense the mass calculated from column "Calcium Carbonate (mg)" and record the mass in column "Measured Mass of Calcium Carbonate (mg)"

10.7.4 Dispensing of Methyl Cellulose 10.7.4.1 Input the "Desired % of Methyl Cellulose" into C3001S: Cannabinoid Infused Rolling Paper Prototype Creation Sheet 10.7.4.2 Place a weighing dish on the mass balance and press the tare button 10.7.4.3 Dispense the mass calculated from column "Methyl Cellulose (mg)" and record the mass in column "Measured Mass of Methyl Cellulose (mg)"

10.7.5 Dispensing of Titanium Dioxide 10.7.5.1 Input the "Desired % of Titanium Dioxide" into C3001S: Cannabinoid Infused Rolling Paper Prototype Creation Sheet 10.7.5.2 Place a weighing dish on the mass balance and press the tare button 10.7.5.3 Dispense the mass calculated from column "Titanium Dioxide (mg)" and record the mass in column "Measured Mass of Titanium Dioxide (mg)"

10.7.6 Dispensing of Cationic Starch 10.7.6.1 Input the "Desired % of Cationic Starch" into C3001S: Cannabinoid Infused Rolling Paper Prototype Creation Sheet 10.7.6.2 Place a weighing dish on the mass balance and press the tare button 10.7.6.3 Dispense the mass calculated from column "Cationic Starch (mg)" and record the mass in column "Measured Mass of Cationic Starch (mg)"

10.7.7 Dispensing of Magnesium Carbonate 10.7.7.1 Input the "Desired % of Magnesium Carbonate" into C3001S: Cannabinoid Infused Rolling Paper Prototype Creation Sheet 10.7.7.2 Place a weighing dish on the mass balance and press the tare button 10.7.7.3 Dispense the mass calculated from column "Magnesium Carbonate (mg)" and record the mass in column "Measured Mass of Magnesium Carbonate (mg)"

10.7.8 Charge all mass measured constituents for the creation of a cannabinoid infused rolling paper prototype into the pulping blender 10.7.8.1 Blend on high for no less than 30 minutes 10.8 Dispense *Cannabis* Oil 10.8.1 Input the averaged triplicate potency for THC or CBD into C3001S: Cannabinoid Infused Rolling Paper Prototype Creation Sheet and the associated sample number.

10.8.2 Dispense the mass calculated from column "Target Mass of *Cannabis* Oil (mg)" into a tared Dram Jar and record the mass in column "Measured Mass of *Cannabis* Oil (mg)"

10.8.3 Charge 1 mL of 200 proof ethanol into Dram Jar with dispensed cannabis oil.

10.8.4 Cap the Dram Jar and mix until no discernable bi-layer is detected.

10.8.5 Charge the ethanol cannabinoid tincture into the blended paper slurry and mix for a minimum of 20 minutes 10.8.6 The resulting mixture should appear even in texture and color, if not, mix for an additional 10 minutes.

10.9 Creation of the Cannabinoid Infused Rolling Paper Prototype Web 10.9.1 Build the Web making Deckle by sandwiching a screen and grid piece between two wooden deckle pieces 10.9.2 Place the completed Deckle into the silicone rectangular basin 10.9.3 Pour the blended paper and cannabinoid slurry through the deckle screen until the level of liquid in the silicone rectangular basin is above the screen level 10.9.4 Gently squeeze the sandwiched deckle together and move it back and forth under the slurry layer to achieve and even dispersion of web slurry 10.9.5 Lift the sandwiched deckle evenly out of the silicone rectangular basin and turn it 90 degrees so the deckle may rest above the slurry level and drain effluent white water back into the basin 10.9.6 Allow the deckle to drain for 10 minutes 10.9.7 After the initial drying period, remove the top wooden deckle 10.9.8 Lift the screen off of the grid and flip it over onto a couch drying sheet which has been placed on a drying felt sheet 10.9.9 Gently peel the screen material back revealing a web on the opposing couch drying sheet 10.9.10 Place another couch drying sheet and a felt drying sheet on top of the newly created web 10.9.11 Place the sandwiched web in the Power Heat Press and close the handle for a minimum of 700 seconds at 110 degrees celsius 10.9.12 Once the minimum amount of heated power pressing has been achieved, lift the Power Heat Press' handle and remove the sandwiched web 10.9.13 Peel away the top drying felt and couch sheet to reveal a newly dried paper than can be removed by peeling it away from the opposing couch and felt drying sheets.

10.10 QC Analysis for Content Uniformity 10.10.1 Cut as many rolling paper sized sheets out of the dried paper. The dimensions must be uniform between all samples i.e. L: 2.96" W: 1.72" Mass: 57.63 mg Area: 5.09"^2 for a standard rolling paper 10.10.2 Measure the mass of each individual paper and assign a sample number. Repeat for all remaining papers 10.10.3 Submit all samples to the internal QC department or a 3rd party analytical lab for potency analysis 10.10.4 Once the results are ready, calculate the potency average, mean, standard deviation, and relative standard deviation 10.10.5 Compare computed statistical analysis with specified pass/fail criteria 10.10.5.1 In the measure of THC, a relative standard deviation of 10% or less constitutes a "PASS" designation 10.10.5.2 In the measure of THC, a relative standard deviation of greater than 10% constitutes a "FAIL" designation.

Appendix B shows the Standard Operating Procedure for manufacturing and testing the sizing agent precisely in a laboratory environment. The sizing agent, with the emulsifier, is combined with the cannabinoid containing cannabis extract. That combination, too, can be first simulated in a lab for initial quantity and concentration control.

APPENDIX B

1. Title: Cannabinoid Infused Paper Sizing Agent Formulation for Rolling Paper Creation 2. Purpose: This Standard Operating Procedure ("SOP") describes the process of creating a cannabinoid infused paper sizing agent formulation for infusion into paper during the paper manufacturing process.

3. Scope: This procedure pertains to any manufacturing or processing personnel performing cannabinoid infused paper sizing agent formulation.

4. Responsibility: The Quality Assurance Manager shall ensure that any manufacturing and quality control personnel are trained and proficient to complete this SOP properly.

5. References:

5.1: "The Papermaking Process" a general guide to paper manufacture and formulation 6. Abbreviations and Definitions:

6.1: THC: Delta-9-Tetrahydrocannabinol, CAS #1972-08-3

6.2: Blended Paper Slurry: a liquid combination of paper making components and cannabis oil 7. Frequency:

7.1: Utilize when the creation of a cannabinoid infused sizing agent prototype is needed.

8. Equipment and Supplies Necessary to Complete SOP:

8.1 Worksheet "C3002: Cannabinoid Infused Sizing Agent Formulation Sheet"

8.2 Cannabinoid containing Oils with corresponding cannabinoid potency determined by a qualified testing laboratory 8.3 Calibrated Analytical Balance featuring a repeatability of +/−0.1 g 8.4 2× Clean airtight containers with sufficient capacity to contain the volume of the formulation 8.7 Wand Homogenizer 8.8 Distilled Water 8.9 200 Proof Ethanol 8.10 Glycerin 8.11 Sorbitol 8.12 Methyl Cellulose 8.14 50 mL polypropylene screw-top tube 8.15 Laboratory Marker ("Sharpie")

8.16 Glass Beaker with sufficient volume to contain the cannabis oil and ethanol used in the formulation.

9. General Information:

10. Procedure:

10.1 Utilize a Calibrated Mass Balance for each mass measurement 10.2 Assign a sample identification number for the prototype being created 10.3 Formulate the Sizing Agent Base Formulation: All data entry and calculations will occur on associated worksheet C3002S: Cannabinoid Infused Sizing Agent Formulation Sheet in the first tab entitled "Sizing Agent Base Formulation"

10.3.1 Place a Clean container with sufficient capacity to contain the volume of the formulation on the calibrated mass balance and press the tare button 10.3.2 Enter the "Target Mass of Finished Formulation (g)" into the worksheet 10.3.3 Designate and enter the "Target composition of Glycerine in formulation (% w/w)" into the worksheet. The worksheet will calculate a "Calculated target Mass of Glycerine to add to formulation (g)"

10.3.4 Dispense the "Calculated target Mass of Glycerine to add to formulation (g)" into the clean container located on the balance and record the "Measured Mass of Glycerine Added to Formulation (g)" into the worksheet.

10.3.5 Designate and enter the "Target composition of water in formulation (% w/w)" The worksheet will calculate a "Calculated target Mass of Water to add to formulation (g)"

10.3.6 Tare the mass of the Container and its contents located on the balance.

10.3.7 Dispense the "Calculated target Mass of Water to add to formulation (g)" into the container and record the "Measured Mass of Water Added to Formulation (g)" into the worksheet.

10.3.8 Designate and enter the "Target composition of sorbitol in formulation (% w/w)" The worksheet will calculate a "Calculated target mass of Sorbitol to add to formulation (g)"

10.3.9 Tare the mass of the Container and its contents located on the balance.

10.3.10 Dispense the "Target Mass of Sorbitol to add to formulation (g)" into the container located on the balance and record the "Measured Mass of Sorbitol Added to Formulation (g)" into the worksheet 10.3.11 Designate and enter the "Target composition of Methylcellulose in formulation (% w/w)" into the worksheet. The worksheet will calculate a "Calculated target mass of MethylCellulose to add to formulation (g)"

10.3.12 Tare the mass of the Container and its contents located on the balance.

10.3.13 Dispense "Target Mass of Methylcellulose to add to formulation (g)" and record the "Measured Mass of Methylcellulose Added to Formulation (g)" into the worksheet.

10.4 Infusion of Sizing Agent Base Formulation with Cannabinoid: All data entry and calculations will occur on associated work-sheet C3002S: Cannabinoid Infused Sizing Agent Formulation Sheet in the second tab entitled "Infusion of Base Sizing Agent with Cannabinoids"

10.4.1 Designate and enter the "Desired Mass of Cannabinoid Infused Sizing agent to Formulate (g)" into the worksheet 10.4.2 Designate and enter the "Desired Target THC Potency of final sizing agent formula (% w/w)" into the worksheet 10.4.3 Designate and enter the "*Cannabis* Oil Utilized (sample #)" into the worksheet 10.4.4 Designate and enter the "Measured THC Potency of *Cannabis* Oil Used for formulation (% w/w)" into the worksheet.

10.4.5.1 Once the information from steps 10.4.1 through 10.4.3 are entered, the work-sheet C3002S: Cannabinoid Infused Sizing Agent Formulation Sheet will calculate the "Calculated Target Proportion of *Cannabis* Oil to add to Sizing Agent Formulation (% w/w)" and "Target Mass of Sizing Agent Base to add to formulation (g)"

10.4.6 Prepare the *Cannabis* Oil in Ethanol Formulant 10.4.6.1. Place a clean glass beaker with an appropriate capacity to contain the volume of ethanol and cannabis oil for the formulation onto the analytical balance and tare the resulting mass.

10.4.6.2 Dispense the "Calculated Target Mass of *Cannabis* Oil to add to formulation (g)" reported in the worksheet into the clean glass beaker and record the resulting measurement into, "Measured Mass of *Cannabis* Oil Added to Formulation (g)"

10.4.6.3 Tare the glass beaker and its contents 10.4.6.4 Dispense the calculated, "Target Mass of Ethanol to Add to formulation (mL)" into the beaker containing the measured mass of cannabis oil and record the "Measured mass of Etoh added (g)"

10.4.6.5 swirl the contents of the glass beaker together until the oil has homogeneously dispersed into the ethanol to create a homogenous tincture and set aside.

10.4.7 Affix a label onto a clean airtight container with sufficient volume to contain the entire resulting formulation for the purpose of recording the tare mass of the vessel 10.4.8 Place the clean airtight container (with lid) to contain the formulation onto the calibrated analytical balance and measure the mass of the container.

10.4.9 Using a laboratory marker, record the tare mass of the container with lid onto the label 10.4.# Remove the lid of the clean airtight container press the tare button on the analytical balance to tare the mass of the container used for the formulation 10.4.10 While the airtight container remains on the analytical balance, dispense the "Calculated Target Mass of Sizing Agent Base to add to formulation" formulated in Procedure 10.3 and enter the resulting "Measured Mass of Sizing Agent added (mg)" into the worksheet 10.4.11 Press the Tare button on the analytical balance to re-zero the balance 10.4.12 While the airtight container remains on the analytical balance, pour the contents of the glass beaker containing the "*Cannabis* Oil in Ethanol Formulant" from Procedure 10.4.# into the airtight container ensuring that the entire contents are carefully added 10.4.13 Utilizing the Wand Homogenizer, mix formulation for 20 minutes.

10.4.14 Examine the resulting homogenized mixture for any sign of a lack of content uniformity 10.4.15 If there are signs of lack of content uniformity such as a non homogeneous coloration, oil slick on the top of the formulation or differing densities of material repeat procedure 10.4.# until there are no discernable signs of lack of formulation uniformity 10.5 Quality Control Analysis for Content Uniformity 10.5.1 Dispense 100 mg of resulting Cannabinoid Infused Paper Sizing Agent Formulation for Rolling Paper Creation into a fresh 50 mL polypropylene screw-top tube. Repeat two more times for a total of 3 samples.

10.5.2 Assign a sample number. Repeat for all remaining samples 10.5.3 Submit all samples to the internal quality control department or a 3rd party analytical lab for cannabinoid potency analysis 10.5.4 Once the cannabinoid potency results are available, calculate the potency average, mean, standard deviation, and relative standard deviation 10.5.5 Compare computed statistical analysis with specified pass/fail criteria 10.5.5.1 In the measure of THC, a relative standard deviation of 10% or less constitutes a "PASS" designation 10.5.1 In the measure of THC, a relative standard deviation of greater than 10% constitutes a "FAIL" designation. Repeat procedure 10.4.9, "Utilizing the Wand Homogenizer, mix formulation for 20 minutes." and then repeat procedure 10.5 in its entirety.

The disclosed embodiment is illustrative and not meant to be restrictive. The scope of the invention is defined by the claims herein as interpreted by the Courts. While specific configurations of the invention have been described, it is to be understood that the present invention can be applied in a wide variety of ways without departing from the basic teaching of the invention. There are many alternative ways of implementing the present invention as will appear and be apparent to those of ordinary skill in the art of paper making and the chemistry and mechanics of paper-making.

The invention claimed is:

1. A rolling paper, for use in connection with rolling and forming a smokable object, comprising an infused cannabinoid and an emulsifying agent, said rolling paper made by a paper-making process comprising infusing a cannabinoid prior to a dried paper product being formed, wherein infusing the cannabinoid includes a step of adding cannabinoid containing cannabis extract and the emulsifying agent during a pulping step, a web forming step, and/or a sizing step.

2. The rolling paper of claim 1, wherein the cannabinoid containing cannabis extract is added to the sizing step of the paper-making process.

3. The rolling paper of claim 2, wherein said emulsifying agent is used for creating an emulsion comprising the cannabinoid containing cannabis extract during the sizing step of the paper-making process.

4. The rolling paper of claim 3, wherein said emulsifying agent is selected from the group consisting of a modified starch, Dextrin, tapioca, and hydroxy-propyl-methyl-cellulose.

5. The rolling paper of claim 3, wherein said emulsifying agent is hydroxy-propyl-methyl-cellulose.

6. The rolling paper of claim 2, wherein said cannabinoid containing cannabis extract is placed or provided onto one or more rollers used in the sizing step of the paper-making process.

7. The rolling paper of claim 1, wherein the step of adding cannabinoid containing cannabis extract is during both the pulping and sizing steps.

8. The rolling paper of claim 7, wherein said emulsifying agent is selected from the group consisting of a modified starch, Dextrin, tapioca, and hydroxy-propyl-methyl-cellulose.

9. The rolling paper of claim 7, wherein said emulsifying agent is hydroxy-propyl-methyl-cellulose.

10. A set of rolling papers, for use in connection with rolling and forming smokable objects, said set comprising interleaved rolling papers formed into a pocket-sized package, wherein each rolling paper of said set comprises an infused cannabinoid and an emulsifying agent, said rolling paper made by a paper-making process comprising infusing a cannabinoid prior to a dried paper product being formed, wherein infusing the cannabinoid includes a step of adding cannabinoid containing cannabis extract and the emulsifying agent during a pulping step, a web forming step, and/or a sizing step.

11. The set of claim 10, wherein the cannabinoid containing cannabis extract is added to the sizing step of the paper-making process.

12. The set of claim 11, wherein said emulsifying agent is used for creating an emulsion comprising the cannabinoid containing cannabis extract during the sizing step of the paper-making process.

13. The set of claim 12, wherein said emulsifying agent is selected from the group consisting of a modified starch, Dextrin, tapioca, and hydroxy-propyl-methyl-cellulose.

14. The set of claim 12, wherein said emulsifying agent is hydroxy-propyl-methyl-cellulose.

15. The set of claim 11, wherein said cannabinoid containing cannabis extract is placed or provided onto one or more rollers used in the sizing step of the paper-making process.

16. The set of claim 10, wherein the step of adding cannabinoid containing cannabis extract is during both the pulping and sizing steps.

17. The set of claim 16, wherein said emulsifying agent is selected from the group consisting of a modified starch, Dextrin, tapioca, and hydroxy-propyl-methyl-cellulose.

18. The set of claim 16, wherein said emulsifying agent is hydroxy-propyl-methyl-cellulose.

19. The set of claim 10, wherein said rolling paper of said set is ingestible.

20. The set of claim 10, wherein said rolling paper of said set comprises a flavorant.

* * * * *